US008590401B2

(12) United States Patent
Conquergood et al.

(10) Patent No.: US 8,590,401 B2
(45) Date of Patent: Nov. 26, 2013

(54) METHOD AND SYSTEM FOR CONTROLLING TONGS MAKE-UP SPEED AND EVALUATING AND CONTROLLING TORQUE AT THE TONGS

(75) Inventors: Steve Conquergood, Priddis (CA); David Lord, Midland, TX (US)

(73) Assignee: Key Energy Services, LLC, Houston, TX (US)

( * ) Notice: Subject to any disclaimer, the term of this patent is extended or adjusted under 35 U.S.C. 154(b) by 809 days.

(21) Appl. No.: 12/627,529

(22) Filed: Nov. 30, 2009

(65) Prior Publication Data

US 2010/0132180 A1 Jun. 3, 2010

Related U.S. Application Data

(60) Provisional application No. 61/118,490, filed on Nov. 28, 2008.

(51) Int. Cl.
*G01L 3/00* (2006.01)

(52) U.S. Cl.
USPC ..... 73/862.08

(58) Field of Classification Search
USPC ..... 73/760, 862.08, 761
See application file for complete search history.

(56) References Cited

U.S. PATENT DOCUMENTS

| | | | |
|---|---|---|---|
| 3,142,210 | A | 7/1964 | Rogers |
| 3,768,573 | A | 10/1973 | Jennings |
| 3,847,040 | A | 11/1974 | Bufkin |
| 3,955,662 | A | 5/1976 | Thackston |
| 3,964,552 | A | 6/1976 | Slator |
| 3,973,434 | A | 8/1976 | Smith |
| 4,091,451 | A | 5/1978 | Weiner et al. |
| 4,106,176 | A | 8/1978 | Rice et al. |
| 4,176,436 | A | 12/1979 | McCombs et al. |
| 4,199,032 | A | 4/1980 | Weiner et al. |
| 4,202,225 | A | 5/1980 | Sheldon et al. |
| 4,208,775 | A | 6/1980 | McCombs et al. |
| 4,208,919 | A | 6/1980 | Motsinger |
| 4,210,017 | A | 7/1980 | Motsinger |
| 4,305,472 | A | 12/1981 | Brossette |
| 4,365,402 | A | 12/1982 | McCombs et al. |
| 4,400,785 | A | 8/1983 | Wallace et al. |
| 4,402,052 | A | 8/1983 | Stone et al. |
| 4,418,931 | A | 12/1983 | Howard |
| 4,446,745 | A | 5/1984 | Stone et al. |

(Continued)

FOREIGN PATENT DOCUMENTS

JP 03-054430 A 3/1991

*Primary Examiner* — Max Noori
(74) *Attorney, Agent, or Firm* — King & Spalding LLP

(57) ABSTRACT

Make-up speed for a tongs drive system is monitored and controlled to maintain the speed within a limited target range either throughout the make-up process or during the final portion of the make-up process, thereby improving make-up consistency and allowing for improved evaluation or torque during the make-up process. An encoder generates speed and position data during the make-up process. The speed data is compared to a target speed, which is based on rod and/or tongs characteristics. If the speed does not match the target speed or is not within a range of the target speed, a signal is transmitted to the tongs drive to adjust the speed accordingly. Furthermore, position data from the encoder, or other position sensors, provide position data for the rod during the make-up process to limit or vary the speed control parameters during different portions of the make-up process.

14 Claims, 13 Drawing Sheets

(56) References Cited

U.S. PATENT DOCUMENTS

| | | | | |
|---|---|---|---|---|
| 4,501,335 | A | 2/1985 | Gann | |
| 4,552,041 | A | 11/1985 | Coyle, Sr. | |
| 4,578,642 | A | 3/1986 | Moake et al. | |
| 4,592,125 | A | 6/1986 | Skene | |
| 4,604,724 | A | 8/1986 | Shaginian et al. | |
| 4,640,245 | A | 2/1987 | Matsuda et al. | |
| 4,679,469 | A | 7/1987 | Coyle, Sr. | |
| 4,700,787 | A | 10/1987 | Buck et al. | |
| 4,730,254 | A | 3/1988 | Voden, Jr. | |
| 4,738,145 | A | 4/1988 | Vincent et al. | |
| 4,765,401 | A | 8/1988 | Boyadjieff | |
| 4,901,805 | A | 2/1990 | Ali-Zade et al. | |
| 4,938,109 | A * | 7/1990 | Torres et al. | 81/467 |
| 5,040,827 | A | 8/1991 | DeLange | |
| 5,087,177 | A | 2/1992 | Haley et al. | |
| 5,099,725 | A | 3/1992 | Bouligny, Jr. et al. | |
| RE34,063 | E | 9/1992 | Vincent et al. | |
| 5,195,406 | A | 3/1993 | Lindqvist | |
| 5,245,265 | A | 9/1993 | Clay | |
| 5,335,487 | A | 8/1994 | Murakawa et al. | |
| 5,402,688 | A | 4/1995 | Okada et al. | |
| 5,502,883 | A | 4/1996 | Ohmi et al. | |
| 5,668,328 | A | 9/1997 | Steber et al. | |
| 5,711,382 | A | 1/1998 | Hansen et al. | |
| 5,823,074 | A | 10/1998 | Ahlstone | |
| 5,890,403 | A | 4/1999 | Buck | |
| 5,988,299 | A | 11/1999 | Hansen et al. | |
| 6,003,412 | A | 12/1999 | Dlask et al. | |
| 6,079,490 | A | 6/2000 | Newman | |
| 6,209,639 | B1 | 4/2001 | Newman | |
| 6,212,763 | B1 * | 4/2001 | Newman | 29/702 |
| 6,263,763 | B1 | 7/2001 | Feigel, Jr. et al. | |
| 6,276,449 | B1 | 8/2001 | Newman | |
| 6,334,376 | B1 * | 1/2002 | Torres | 81/372 |
| 6,374,706 | B1 * | 4/2002 | Newman | 81/57.34 |
| 6,758,095 | B2 | 7/2004 | Newman | |
| 7,856,908 | B2 * | 12/2010 | Holladay et al. | 81/57.16 |
| 7,997,165 | B2 * | 8/2011 | Holladay et al. | 81/57.16 |
| 8,280,639 | B2 * | 10/2012 | Conquergood et al. | 702/9 |
| 2001/0000550 | A1 | 5/2001 | Newman | |

* cited by examiner

Notes:
1) Operator threads one turn of the connection by hand
2) Entering the makeup region at controlled speed ensures consistent quality connections.

METHOD AND SYSTEM FOR CONTROLLING TONGS MAKE-UP SPEED AND EVALUATING AND CONTROLLING TORQUE AT THE TONGS

STATEMENT OF RELATED PATENT APPLICATION

This non-provisional patent application claims priority under 35 U.S.C. §119 to U.S. Provisional Patent Application No. 61/118,490, titled *Method and System for Setting and Controlling Tongs Make-up Speed*, filed Nov. 28, 2008. This provisional application is hereby fully incorporated herein by reference.

FIELD OF THE INVENTION

The current invention generally relates to assembling threaded sucker rods and tubulars of oil wells and other wells. More specifically, the invention pertains to a device that monitors and controls the speed by which sucker rods and other tubulars are coupled.

BACKGROUND OF THE INVENTION

Oil wells and many other types of wells often comprise a well bore lined with a steel casing. A casing is a string of pipes that are threaded at each end to be interconnected by a series of internally threaded pipe couplings. A lower end of the casing is perforated to allow oil, water, gas, or other targeted fluid to enter the interior of the casing.

Disposed within the casing is another string of pipes interconnected by a series of threaded pipe couplings. This internal string of pipes, known as tubing, has a much smaller diameter than casing. Fluid in the ground passes through the perforations of the casing to enter an annulus between the inner wall of the casing and the outer wall of the tubing. From there, the fluid forces itself through openings in the tubing and then up through the tubing to ground level, provided the fluid is under sufficient pressure.

If the natural fluid pressure is insufficient, a reciprocating piston pump is installed at the bottom of the tubing to force the fluid up the tubing. A reciprocating drive at ground level is coupled to operate the pump's piston by way of a long string of sucker rods that is driven up and down within the interior of the tubing. A string of sucker rods is typically comprised of individual solid rods that are threaded at each end so they can be interconnected by threaded couplings.

Since casings, tubing, and sucker rods often extend thousands of feet, so as to extend the full depth of the well, it is imperative that their respective coupling connections be properly tightened to avoid costly repair and downtime. Couplings for tubulars (i.e., couplings for tubing and casings), and couplings for sucker rods (referred to collectively herein as "rods" or "sucker rods" are usually tightened using a tool known as tongs. Tongs vary in design to suit particular purposes, i.e., tightening tubulars or rods, however, each variety of tongs shares a common purpose of torquing one threaded element relative to another. Tongs typically include a hydraulic motor that delivers a torque to a set of jaws that grip the element or elements being tightened.

Various control methods have been developed in an attempt to ensure that sucker rods are properly tightened. However, properly tightened joints can be difficult to consistently achieve due to numerous rather uncontrollable factors and widely varying specifications of sucker rods. For instance, tubing, casings and sucker rods each serve a different purpose, and so they are each designed with different features having different tightening requirements.

But even within the same family of parts, numerous variations need to be taken into account. With sucker rods, for example, some have tapered threads, and some have straight threads. Some are made of fiberglass, and some are made of steel. Some are one-half inch in diameter, and some are over one inch in diameter. With tubing, some have shoulders, and some do not. Even supposedly identical tongs of the same make and model may have different operating characteristics, due to the tongs having varying degrees of wear on their bearings, gears, or seals. Also, the threads of some sucker rods may be more lubricated than others. Some threads may be new, and others may be worn. These are just a few of the many factors that need to be considered when tightening sucker rods and tubulars.

Furthermore, variations in the speed that the tongs generate on the sucker rods during each make-up and at different times during each portion of the make-up process can affect whether the make-up is successful and whether a proper torque is generated at the connection point. In addition, these variations in speed can affect the torque readings being received for evaluation and can result in inconclusive or incorrect analysis as to the quality of the rod, the threads on the rod or coupling, and/or the success of the make-up process for that rod.

Another problem with conventional tongs systems is that, while they provide some level of reference for how tight each connection is made up it is typically done by putting a pressure gauge or electronic pressure transducer on the hydraulic supply to the motor on the tongs. Monitoring this pressure gives an inferred reading of how much torque was applied to each rod connection. Substantial variation and error is introduced using this method due to variations in hydraulic performance (oil viscosity, contamination, flow rates, motor wear, cavitation, leakage) and drive train (friction, wear, lubrication, slip). For a given pressure reading of hydraulic supply to the motor, it cannot be definitive that the torque output was correct.

Consequently, a need exists in the art for a system and method for monitoring and controlling the speed generated by the tongs on a rod or other elongated member during a make-up process. In addition, a need exists in the art for a system and method that maximizes the efficiency of the make-up process while also controlling the speed of the tongs during key portions of the make-up process. Furthermore, a need exists in the art for a system and method for measuring the actual torque generated by tongs on sucker rods during the make-up and/or breakout process.

SUMMARY OF THE INVENTION

For one aspect of the present invention, a method for controlling the speed of a set of tongs during a make-up process can include accepting at a computer processor or other computing device a target speed for making-up the rod during the rod make-up process. The process further includes conducting the make-up of a rod and a coupling with a set of tongs. An actual tong speed can be received at the processor in the form of multiple outputs of actual speed data from a speed sensing device during the make-up process. The processor can determine if the actual tong speed is within a predetermined range of the target speed. The speed of the tongs can then be adjusted so that the actual speed will be within the predetermined range of the target speed if it is determined by the processor to not be so.

For another aspect of the present invention, a method for controlling the speed of a set of tongs during a make-up process can include accepting at a computer processor or other computing device a target speed for making-up the rod during the rod make-up process. The tongs can be started and the rod can be rotated at a first speed by the tongs. The processor can determine if the rod is within a predetermined distance of the shoulder as the make-up process is on-going. If it is determined that the rod is within the predetermined distance of the shoulder, the processor can automatically reduce the speed of the tongs drive to a second speed setting. The processor can receive actual tongs speed data and can determine if the speed data is within a predetermined range of the target speed. The tongs drive can be sped up or slowed down from the second speed setting if actual tongs speed data is not within a predetermined range of the target speed.

For yet another aspect of the present invention, a system for monitoring torque at a set of rod tongs can include rod tongs that have upper jaws and a back-up wrench. A load cell can be positioned adjacent to the back-up wrench and can sense torque from the rod connection being applied to the back-up wrench. A block member can be included, such that the block member can be in contact with the load cell, and rotatably coupled to the backup wrench so that the back-up wrench can transmit a force the load cell.

For still another aspect of the present invention, a method of evaluating and responding to torque signals generated at a set of tongs can include accepting separate high and low torque limits for a rod make-up or breakout process at a processor or other computer device. A value representing a predetermined amount of time can further be accepted at the processor. The make-up process of the rod and coupling can begin with the tongs by applying rotation with the upper jaws of the tongs. A torque signal representing an actual torque can be received from the load cell coupled to the tongs. The actual torque can be compared to the high torque limit to determine if any of the actual torque data is greater than the high torque limit. If some of the actual torque is greater than the high torque limit, the processor can evaluate if the actual torque is greater than the high torque limit for an amount of time that is greater than predetermined amount of time. The tong drive, and thus the make-up process, can be automatically stopped if the actual torque is greater than the high torque limit for an amount of time that is greater than predetermined amount of time. The peak level of torque measured during the rod connection make-up or breakout can also be compared by the processor to the high and low limits received, and signals generated which notify users of the system if acceptable levels have been achieved.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF DRAWINGS

For a more complete understanding of the present invention and the advantages thereof, reference is now made to the following description in conjunction with the accompanying figures in which.

Figure 1:
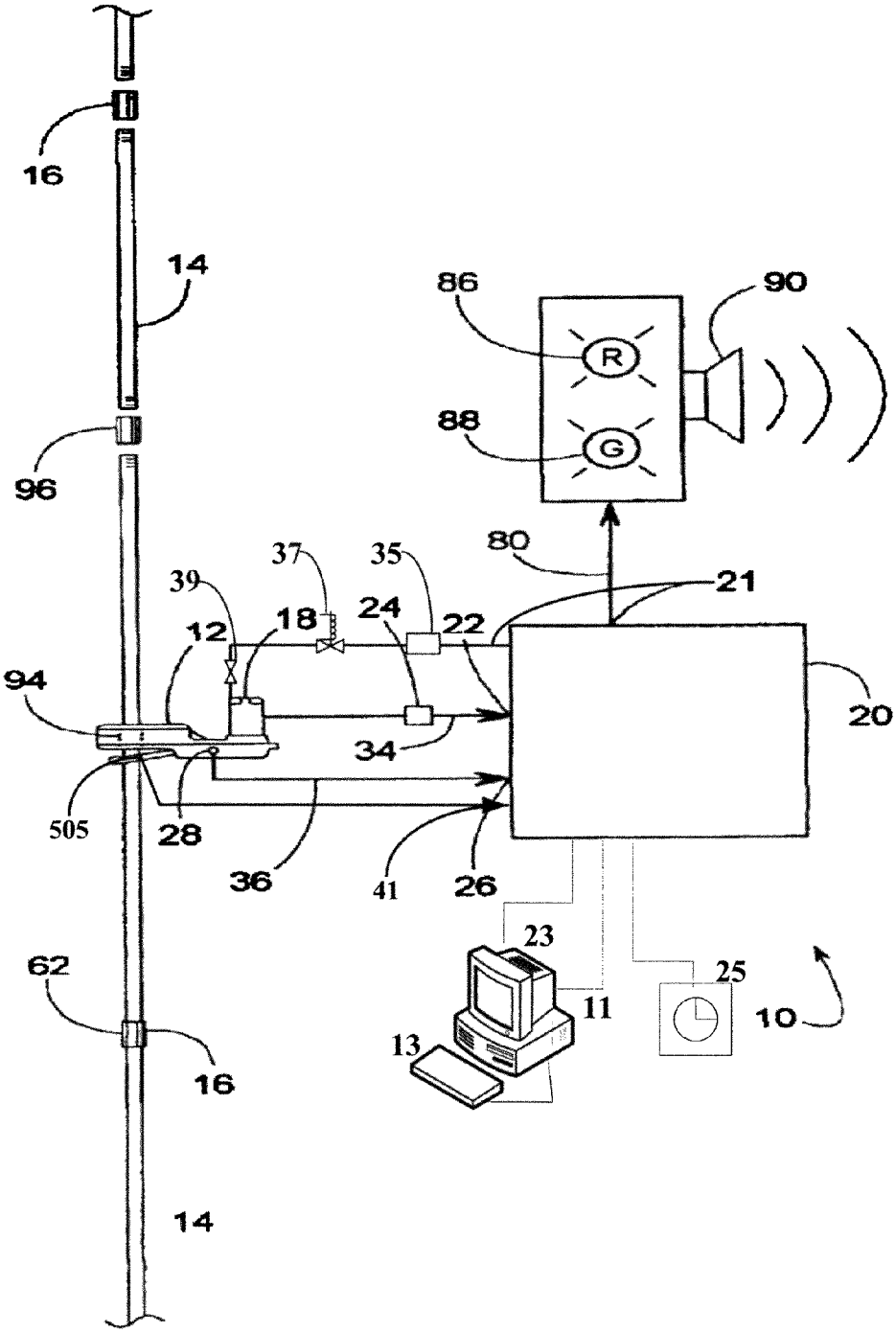
FIG. 1 is a schematic diagram of a system that monitors a set of tongs tightening a string of elongated members according to one exemplary embodiment of the present invention.

Many aspects of the invention can be better understood with reference to the above drawings. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION OF THE EXEMPLARY EMBODIMENTS

The present invention supports a tongs-based system and methods for controlling the make-up and/or breakout speed for rods and other elongated members, such at tubulars and other oil well equipment having threaded connections. Exemplary embodiments of the present invention can be more readily understood by reference to the accompanying figures. The detailed description that follows is represented, in part, in terms of processes and symbolic representations of operations by conventional computing components, including processing units, memory storage devices, display devices, and input devices. These processes and operations may utilize conventional computer components in a distributed computing environment.

Exemplary embodiments of the present invention can include a computer program and/or computer hardware or software that embodies the functions described herein and illustrated in the Figures. It should be apparent that there could be many different ways of implementing the invention in computer programming, including, but not limited to, application specific integrated circuits ("ASIC") and data arrays; however, the invention should not be construed as limited to any one set of the computer program instructions. Furthermore, a skilled programmer would be able to write such a computer program to implement a disclosed embodiment of the present invention without difficulty based, for example, on the Figures and associated description in the application text. Therefore, disclosure of a particular set of program code instructions or database structure is not considered necessary for an adequate understanding of how to make and use the present invention. The inventive functionality will be explained in more detail in the following description and is disclosed in conjunction with the remaining figures.

Figure 1A:
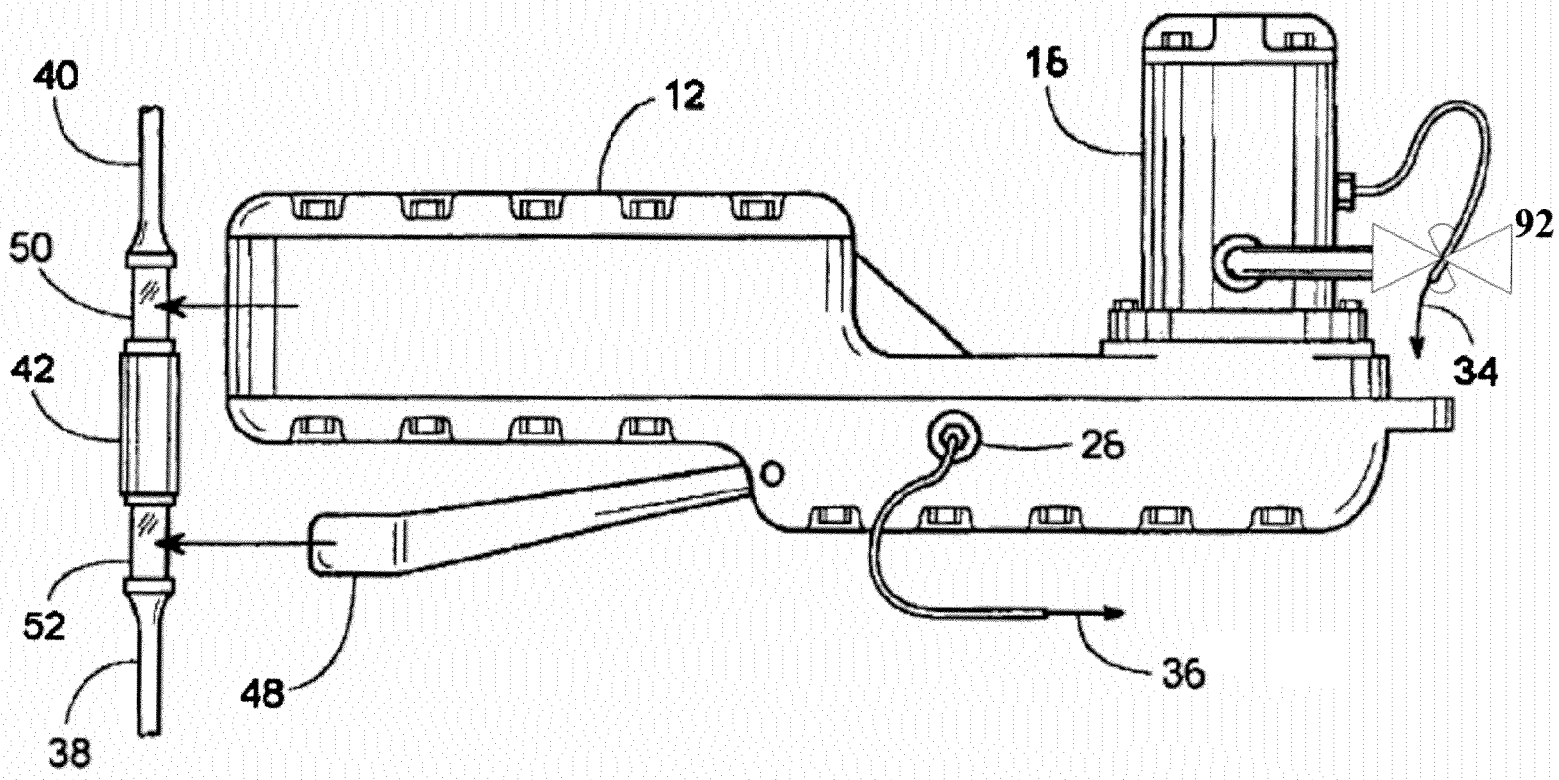
FIG. 1A is a side view of a set of tongs about to tighten two sucker rods into a coupling according to one exemplary embodiment of the present invention.
Figure 1B:
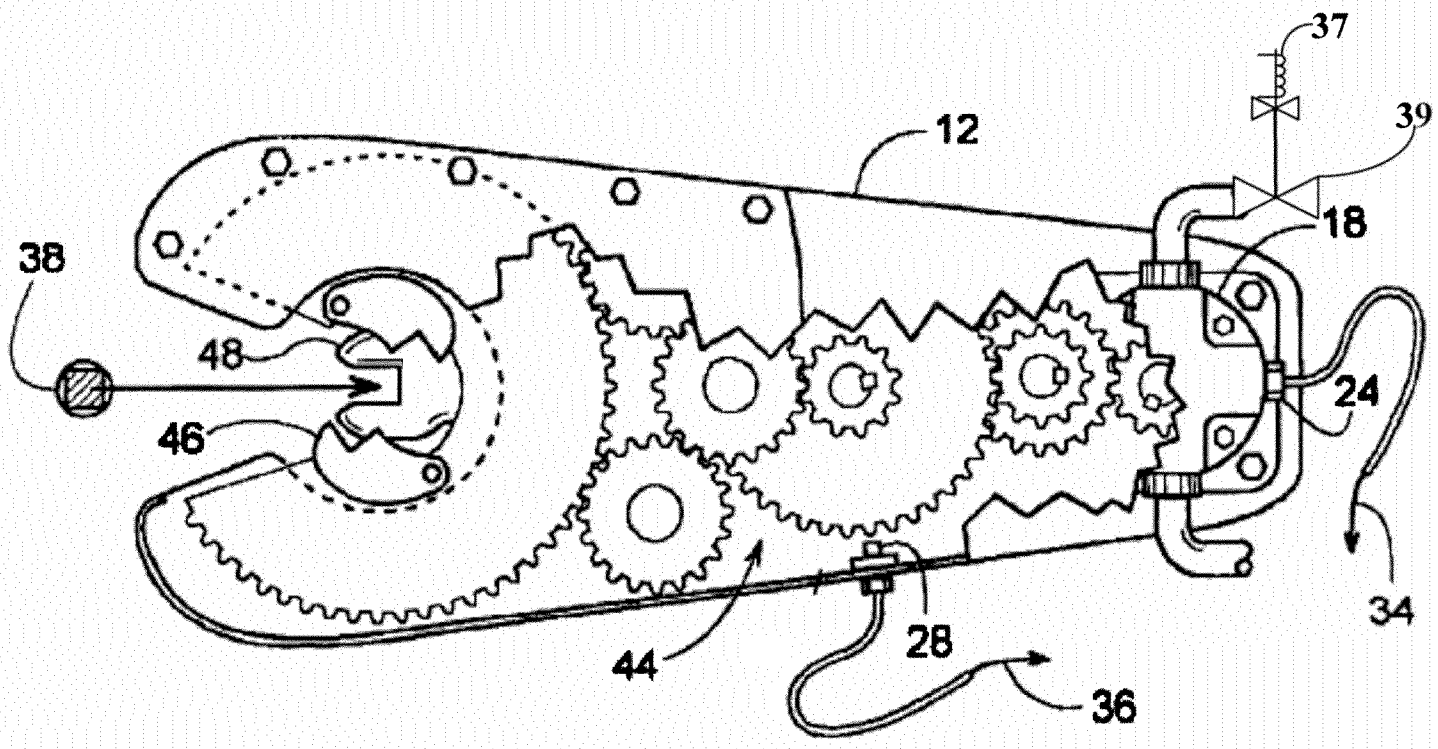
FIG. 1B is a cut-away top view of the tongs according to the exemplary embodiment of FIG. 1A.

Referring now to the drawings, in which like numerals represent like elements throughout the several figures, aspects of the present invention will be described. FIGS. 1, 1A and 1B represent a schematic diagram and other views of a system that monitors a set of tongs tightening a string of elongated members according to one exemplary embodiment of the present invention. Turning now to FIGS. 1, 1A, and 1B, the exemplary system includes a set of tongs 12. The tongs 12 are schematically illustrated to represent various types of tongs including, but not limited to, those used for tightening sucker rods, tubing or casings. In FIG. 1, tongs 12 are shown being used in assembling a string of elongated members 14, which are schematically illustrated to represent any elongated member with threaded ends for interconnecting members 14 with themselves and/or a series of threaded couplings 16. Examples of elongated members 14 include, but are not limited to, sucker rods, tubing, and casings. For ease of reference, the elongated members 14 will be referred to hereinafter as rods; however, no limitation is intended by the use of the term rod.

Tongs 12 include at least one set of jaws 46 and a back-up wrench 48 for gripping and rotating one rod 14 relative to another, thereby screwing at least one rod 14 into an adjacent coupling 16. In one exemplary embodiment, the drive unit 18 is fluidicly coupled to a hydraulic motor and drives the rotation of the jaws 46 gripping the upper rod 40 while the back-up wrench 48 grips the lower rod 38. However, the drive unit 18 is schematically illustrated to represent various types of drive units including those that can move linearly (e.g., piston/cylinder) or rotationally and can be powered hydraulically, pneumatically, or electrically.

In the exemplary embodiment of FIG. 1, the tongs 12 are communicably coupled to an embedded control processor 20, which is communicably coupled to two outputs 21 and four inputs. However, it should be noted that the control processor 20 with fewer inputs/outputs or with inputs other than those used in this example are well within the scope and spirit of the invention. The embedded control processor 20 is schematically illustrated to represent any circuit adapted to receive a signal through an input and respond through an output. Examples of the control processor 20 include, but are not limited to, computers, programmable logic controllers, circuits comprising discrete electrical components, programmable automation controllers, circuits comprising integrated circuits, and various combinations thereof. The embedded control processor 20 can be embedded with the tongs 12 or electrically coupled to the tongs 12 and positioned adjacent to or away from it.

The inputs of the embedded control processor 20, according to some embodiments of the invention, include a first input 22 electrically coupled to a hydraulic pressure sensor 24, a second input 26 electrically coupled to an encoder 28, a third input 41 electrically coupled to the load cell sensor 505 (which is described in greater detail with reference to FIG. 5), a PC 11, and a timer 25. In response to the rotational action of the tongs 12, the encoder 28 provides the input signal 36 to the embedded control processor 20. The term, "rotational action" refers to any rotational movement of any element associated with a set of tongs 12. Examples of such an element include, but are not limited to, gears, jaws, sucker rods, couplings, and tubulars. The term, "tightening action" refers to an effort applied in tightening a threaded connection. In one exemplary embodiment, the encoder 28 is an incremental rotary encoder. This encoder sensor is mounted to the body of the tongs 12 and coupled to the drive mechanism 44 so that it senses rotation in both directions. More specifically, in certain exemplary embodiments, the encoder 28 is a BEI model H25E-F45-SS-2000-ABZC-5V/V-SM12-EX-S. The exemplary encoder 28 generates 2,000 pulses per revolution. The encoder 28 also has a quadrature output, which means 8,000 pulses per revolution can actually be measured. The encoder 28 is mounted in a location which has a drive ratio of 4.833 to the upper jaws 46 holding the sucker rod 14, so 38,666 pulses per rod revolution (or 107 pulses per degree of rod revolution) are generated by the encoder 28.

Since the encoder 28 is mounted directly on the tongs 12, it must have a hazardous area classification. Accordingly, the encoder 28 must be built as an intrinsically safe or explosion proof device to operate in the location of the tongs 12, and monitored through an electronic isolation barrier. The (isolated) encoder pulse signals are measured at the second input 26 by a digital input electronics module, electrically coupled to the embedded control processor 20. As rod speed varies from 0 to 150 revolutions per minute (RPMs), the pulse signals for the encoder 28 vary from 0 to approximately 100,000 pulses per second. To read these high speed pulses accurately, the embedded control processor 20 monitors the digital input signals at 40 MHz frequency. The above measurement using the encoder 28 allows for very precise monitoring of both the position and speed of the rod 14 at all times. In response to the fluid pressure generated by the hydraulic motor that is a part of the tongs drive 18, the hydraulic pressure sensor 24 provides the input signal 34 to the embedded control processor 20.

A personal computer (PC) 11, input device 13, and monitor 23 are also communicably connected to the control processor 20. The input device 13 is communicably connected to the PC 11 and can include a keyboard, mouse, light pen, stencil, or other known input device for a PC or touch pad. The monitor 23 is communicably connected to the PC 11. In one exemplary embodiment, the monitor 23 provides graphic feedback to the operator; however, those of ordinary skill in the art will recognize that the monitor 23 may include, but not be limited to, a CRT, LCD or touch screen display, plotter, printer, or other device for generating graphical representations. The system also includes a timer 25 communicably connected to the control processor 20. In one exemplary embodiment, the timer 25 can be any device that can be employed with a computer, programmable logic controller or other control device to determine the elapsed time from receiving an input.

In certain exemplary embodiments, the timer 25 is integral with the control processor 20 or the PC 11.

The exemplary system further includes an alarm device communicably connected to the embedded control processor 20, such that the embedded control processor 20 generates an output 21 to the alarm device. The alarm device is capable of generating an audible alarm in response to the output signal 21 with a speaker, horn, or other noise making device 90. The alarm device is also capable of generating a visual alarm at the alarm panel lights 86, 88.

The system further includes a pulse width modulated (PWM) amplifier module 35 communicably coupled to the control processor 20. The PWM amplifier module 35 is also communicably coupled to an electrical control solenoid valve 37. In one exemplary embodiment, the PWM amplifier module 35 receives a speed set point value from the embedded control processor 20 and outputs a PWM control signal to the electrical coil solenoid valve 37 at 12 volts direct current (DC) and 20 KHz PWM frequency. The width of the pulses from the PWM amplifier module 35 to the solenoid valve 37 is modulated from 0-100% duty cycle. In one exemplary embodiment, the solenoid valve 37 has a resistance of approximately seven ohms, so the current varies from 0-170 milliamps (mA), corresponding to the 0-100% duty cycle. The electrical coil solenoid valve 37 is communicably connected to a hydraulic spool valve 39. The hydraulic spool valve 39 is fluidicly connected to the hydraulic motor 18. In one exemplary embodiment, the current to the solenoid valve 37 causes changes in the position of the proportional hydraulic spool valve 39. The spool valve 39 changing position varies the flow rate of the hydraulic fluid to the hydraulic motor 18 on the tongs 12.

For illustration, the system will be described with reference to a set of sucker rod tongs 12 used for screwing two sucker rods 38 and 40 into a coupling 42, as shown in FIGS. 1A and 1B. However, it should emphasized that inventive system and methods can be readily used with other types of tongs for tightening other types of elongated members, as discussed above. In this example, a hydraulic motor 18 is the drive unit of the tongs 12. Motor 18 drives the rotation of various gears of a drive train 44, which rotates an upper set of jaws 46 relative to the back-up wrench 48. Upper jaws 46 are adapted to engage flats 50 on sucker rod 40, and the back-up wrench 48 engages the flats 52 on rod 38. So, as the upper jaws 46 rotate relative to the back-up wrench 48, the upper sucker rod 40 rotates relative to lower sucker rod 38, which forces both rods 38 and 40 to tightly screw into the coupling 42.

As discussed above, in the example of FIGS. 1A and 1B, sensor 24 is a conventional hydraulic pressure sensor in fluid communication with motor 18 to sense the hydraulic pressure that drives the motor 18. Generally speaking, with reference to the limitations described above regarding the problems of inferring the relationship between pressure and torque, an increase in the hydraulic pressure from the motor 18 will typically increase the amount of torque exerted by the tongs 12 (all other variables being the same), so the load cell sensor 505 provides an input signal 41 corresponding to a torque level. In certain exemplary embodiments, the hydraulic supply to the motor 18 also includes a pressure relief valve 92. The pressure relief valve 92 limits the pressure that is applied across the motor 18, thus helping to limit the extent to which a connection is tightened. In one exemplary embodiment, the pressure relief valve 92 is adjustable by known adjustment means to be able to vary the amount of hydraulic pressure based on rods and tubes of varying diameters and grades.

Processes of exemplary embodiments of the present invention will now be discussed with reference to FIGS. 2-7. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 2:
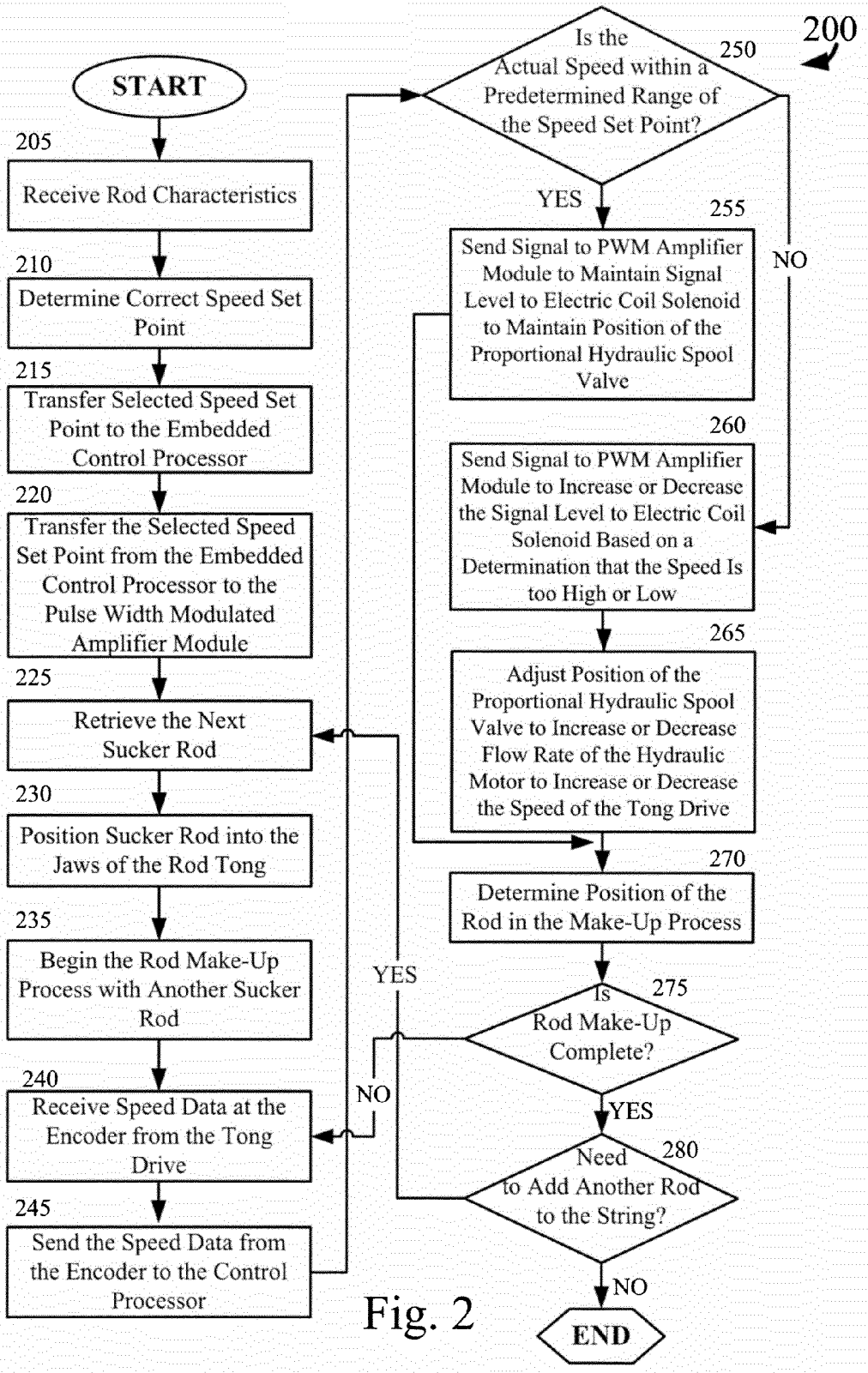
FIG. 2 is a flowchart of an exemplary process for controlling the speed of the tongs drive during the make-up process for a set of tongs connecting a rod to a rod string in accordance with one exemplary embodiment of the present invention.

Turning now to FIG. 2, an exemplary process 200 for controlling the make-up speed for a set of tongs 12 connecting a rod 40 to coupling 42 is shown and described within the exemplary operating environment of FIGS. 1, 1A, and 1B. Now referring to FIGS. 1, 1A, 1B, and 2, the exemplary method 200 begins at the START step and proceeds to step 205, where the rod characteristics are input into the input device 13 and received at the PC 11. In one exemplary embodiment, the rod characteristics include, but are not limited to, rod manufacturer, rod grade, rod size, single or double coupling, single, double, or triple rod string, number of threads on each rod end, and whether the rod is new or used. In step 210, the PC 11 determines the correct rod make-up speed set point (or "target speed"). In one exemplary embodiment, the PC 11 uses a software program and a database of information to determine this set point. In certain exemplary embodiments, the make-up speed set point is within a range of 1-150 RPMs and preferably between 20-40 RPMs. The PC 11 transfers the selected speed set point to the embedded control processor 20 in step 215.

In step 220, the selected speed set point is transferred by the embedded control processor 20 to the PWM amplifier module 35. The next sucker rod 40 is retrieved for coupling in step 225 using known methods and means. In step 230, the sucker rod 40 is positioned into the upper set of jaws 46 on the tongs 12. The rod make-up process begins in step 235 by attaching one rod 40 to another rod 38 with the use of a coupling 42.

In step 240, the encoder 28 receives speed data based on it sensing one or more components in the drive train 44 and/or the tongs drive unit 18. The encoder 28 sends the speed data to the control processor 20 in step 245. In step 250, an inquiry is conducted by the control processor 20 or the PC 11 to determine if the actual speed, as determined by the encoder 28, is within a predetermined range of the speed set point that was determined by the PC 11. In one exemplary embodiment, the predetermined range is a value either input into or previously stored into the control processor 20. In certain exemplary embodiments, the predetermined range can vary from 0-100 RPMs. For example, if the predetermined range is zero RPMs, then any speed received from the encoder 28 that differs from the speed set point would not be within the predetermined range.

If the actual speed is within a predetermined range of the speed set point, the YES branch is followed to step 255, where the control processor 20 transmits a signal to the PWM amplifier module 35 to maintain signal level to the electric coil solenoid valve 37 to maintain the position of the proportional hydraulic spool valve 39. In one exemplary embodiment, the PWM amplifier module outputs a PWM control signal to the electric coil solenoid valve 37 having 12 volts DC and 20 kHz PWM frequency. The width of the pulses is modulated from 0-100% duty cycle. Further, in this exemplary embodiment, the solenoid coil for the electric coil solenoid valve 37 has a resistance of approximately 7 ohms. So the current varies from 0-170 mA, corresponding to the 0-100% duty cycle. The process continues from step 255 to step 270.

Returning to step 250, if the actual speed is not within the predetermined range of the speed set point, the NO branch is followed to step 260, where the control processor 20 transmits a signal to the PWM amplifier module 35 to increase or decrease the signal level to the electrical coil solenoid valve 37 based on a determination that the actual speed is too high or too low. The position of the proportional hydraulic spool valve 39 is adjusted accordingly to increase or decrease the flow rate of the hydraulic motor to increase or decrease the speed of the tongs drive 18 in step 265.

In step 270, the control processor 20 determines the position of the rod 14 in the make-up process. In one exemplary embodiment, the position is determined based on data received from the encoder 28 to calculate the number of revolutions in the make-up process that have been completed. In step 275, an inquiry is conducted to determine if the rod make-up is complete. In one exemplary embodiment, this inquiry and analysis can be completed by either the control processor 20, the PC 11 or an operator. If the rod make-up is not complete, the NO branch is followed to step 240 to receive additional speed data from the encoder 28. Otherwise, the YES branch is followed to step 280.

In step 280, an inquiry is conducted to determine if additional rods 14 still need to be added to the rod string. In one exemplary embodiment, this determination can be made by either the PC 11, the operator, or another person or device. If another rod 14 needs to be added to the rod string, then the YES branch is followed back to step 225, to retrieve the next sucker rod. On the other hand, if the rod string had been completed, the NO branch is followed to the END step.

Figure 3:
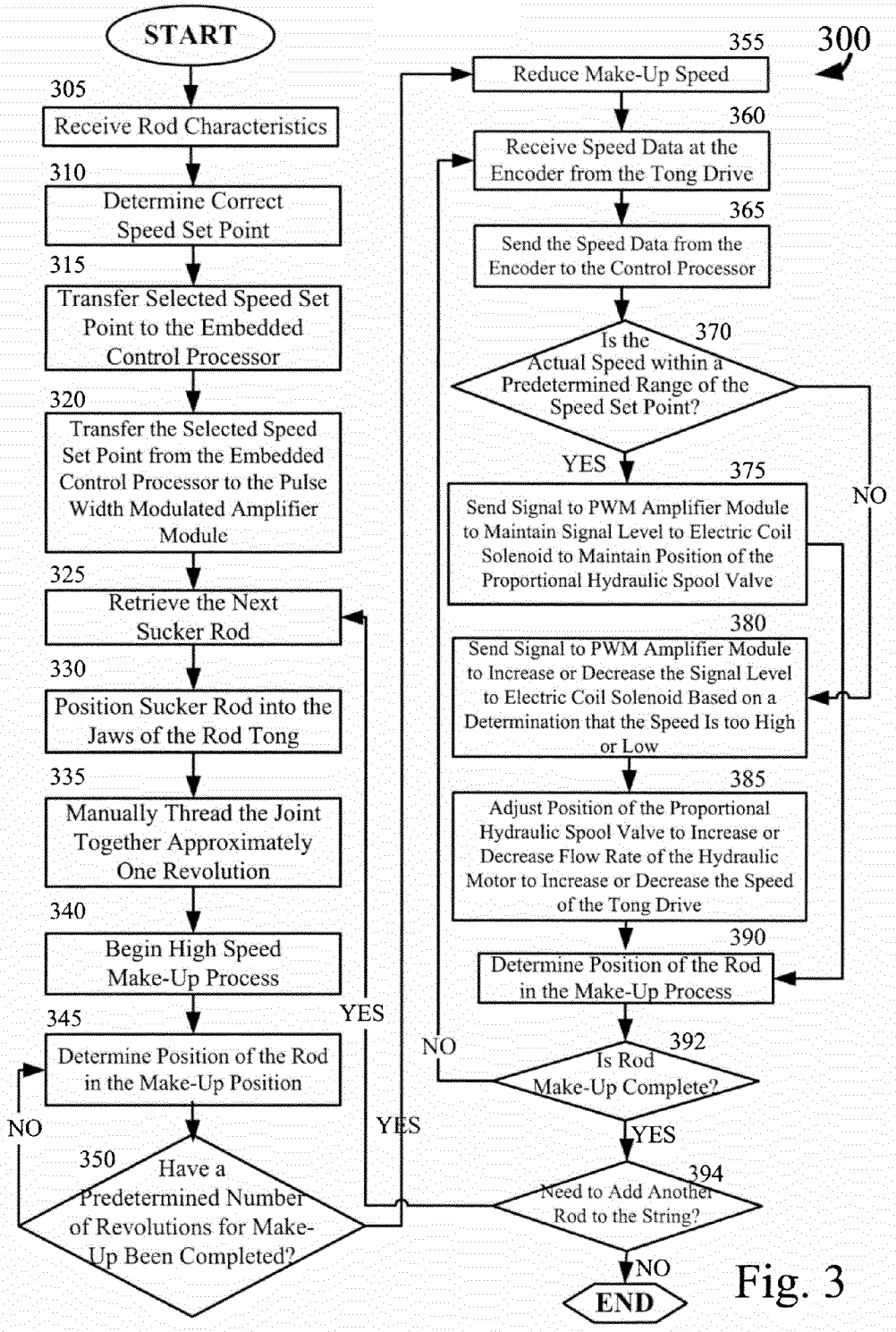
FIG. 3 is a flowchart of another exemplary process for controlling the speed of the tongs drive with varying speeds based on the position of the rod in the make-up process in accordance with one exemplary embodiment of the present invention.

Turning now to FIG. 3, an exemplary process 300 for controlling the speed of the tongs drive 18 with varying speeds based on the position of the rod 14 in the make-up process is shown and described within the exemplary operating environment of FIGS. 1, 1A, and 1B. Now referring to FIGS. 1, 1A, 1B, and 3, the exemplary method 300 begins at the START step and proceeds to step 305, where the rod characteristics are input into the input device 13 and received at the PC 11. In one exemplary embodiment, the rod characteristics include, but are not limited to, rod manufacturer, rod grade, rod size, single or double coupling, single, double, or triple rod string, number of threads on each rod end, and whether the rod is new or used. In the exemplary embodiment described below, the number of threads on each rod end is assumed to be ten threads, however, those of ordinary skill in the art will recognize that the number of threads for each rod end varies from 6-15 threads and the predetermined numbers of revolutions described below for each step are adjusted accordingly.

In step 310, the PC 11 determines the correct rod make-up speed set point. In one exemplary embodiment, the PC 11 uses a software program and a database of information to determine this set point. In certain exemplary embodiments, the make-up speed set point is within a range of 1-150 RPMs and preferably between 20-40 RPMs. The PC 11 transfers the selected speed set point to the embedded control processor 20 in step 315.

In step 320, the selected speed set point is transferred by the embedded control processor 20 to the PWM amplifier module 35. The next sucker rod 40 is retrieved for coupling in step 325 using known methods and means. In step 330, the sucker rod 40 is positioned into the upper set of jaws 46 on the tongs 12. The rod 40 is manually threaded into a coupling 42 a first predetermined number of revolutions by an operator in step 335. In one exemplary embodiment, the first predetermined number of revolutions of the rod 40 for manual thread-up completed by the operator is approximately one revolution of the rod 40. The high speed make-up process begins in step 340. In the exemplary process 300, after the manual thread-up is completed, the rod 40 is threaded at high speed (often called "spin-up") until the shoulder position approaches. In one exemplary embodiment, spin-up occurs at a rate of between 40-200 RPMs and preferably reaches a speed of approximately 150 RPMs. Further, in this exemplary embodiment, the high speed spin-up occurs for approximately a second predetermined number of revolutions, approximately eight revolutions of the rod 40, based on a rod having ten threads, and based on position feedback data derived from the encoder signals. In alternative exemplary embodiments for rods having greater or fewer than ten threads, the second predetermined number of revolutions is approximately equal to the number of threads for the rod 40 minus the first predetermined number of revolutions and further minus one additional revolution. For example, if the rod 40 has fourteen threads and the manual make-up with the first predetermined number of revolutions was one revolution, then the second predetermined number of revolutions would be approximately twelve revolutions, since fourteen minus one minus one equals twelve.

Figure 8:
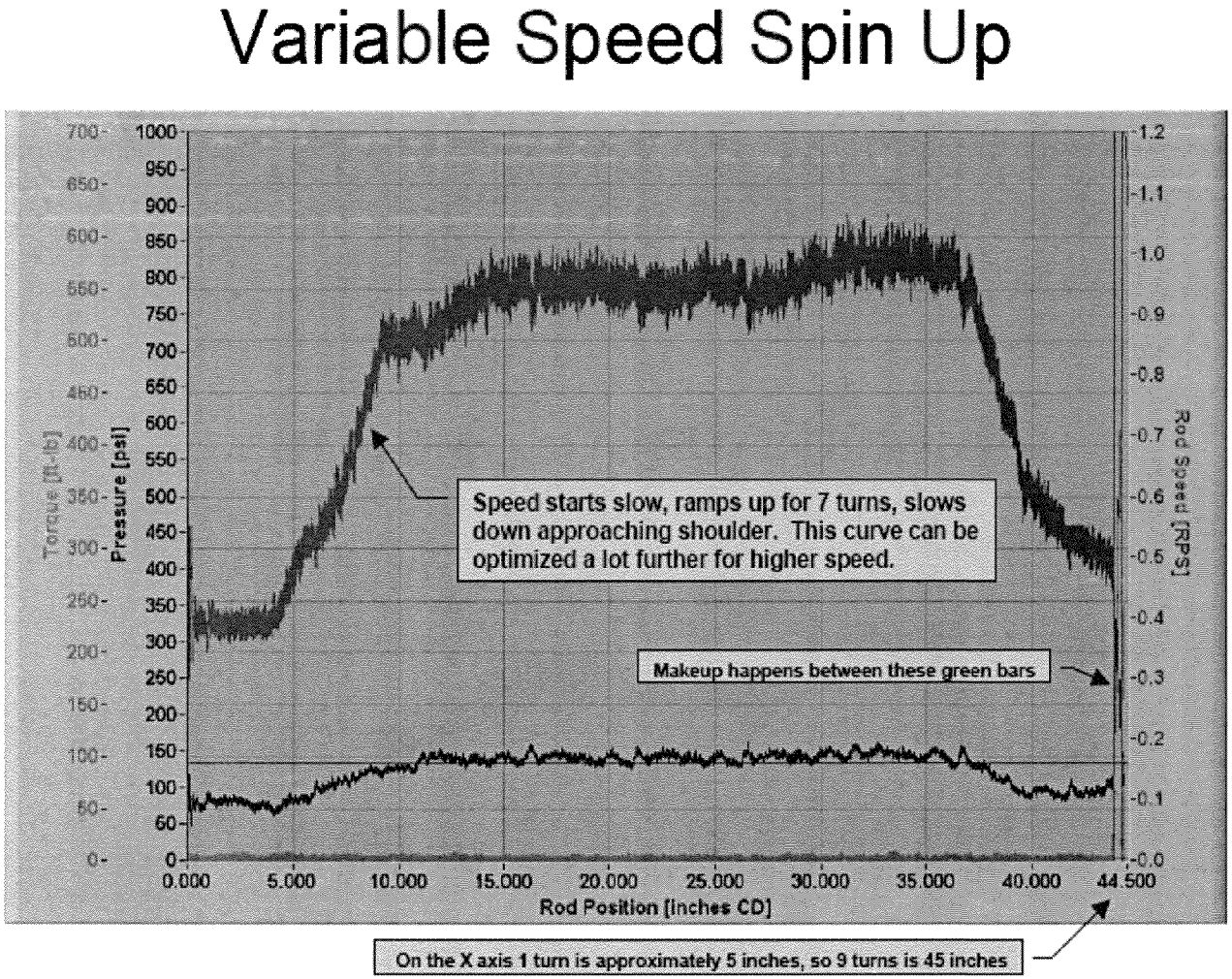
FIG. 8 is an exemplary chart displaying a comparison of rod speed and torque during a make-up process in accordance with one exemplary embodiment of the present invention.
Figure 9:
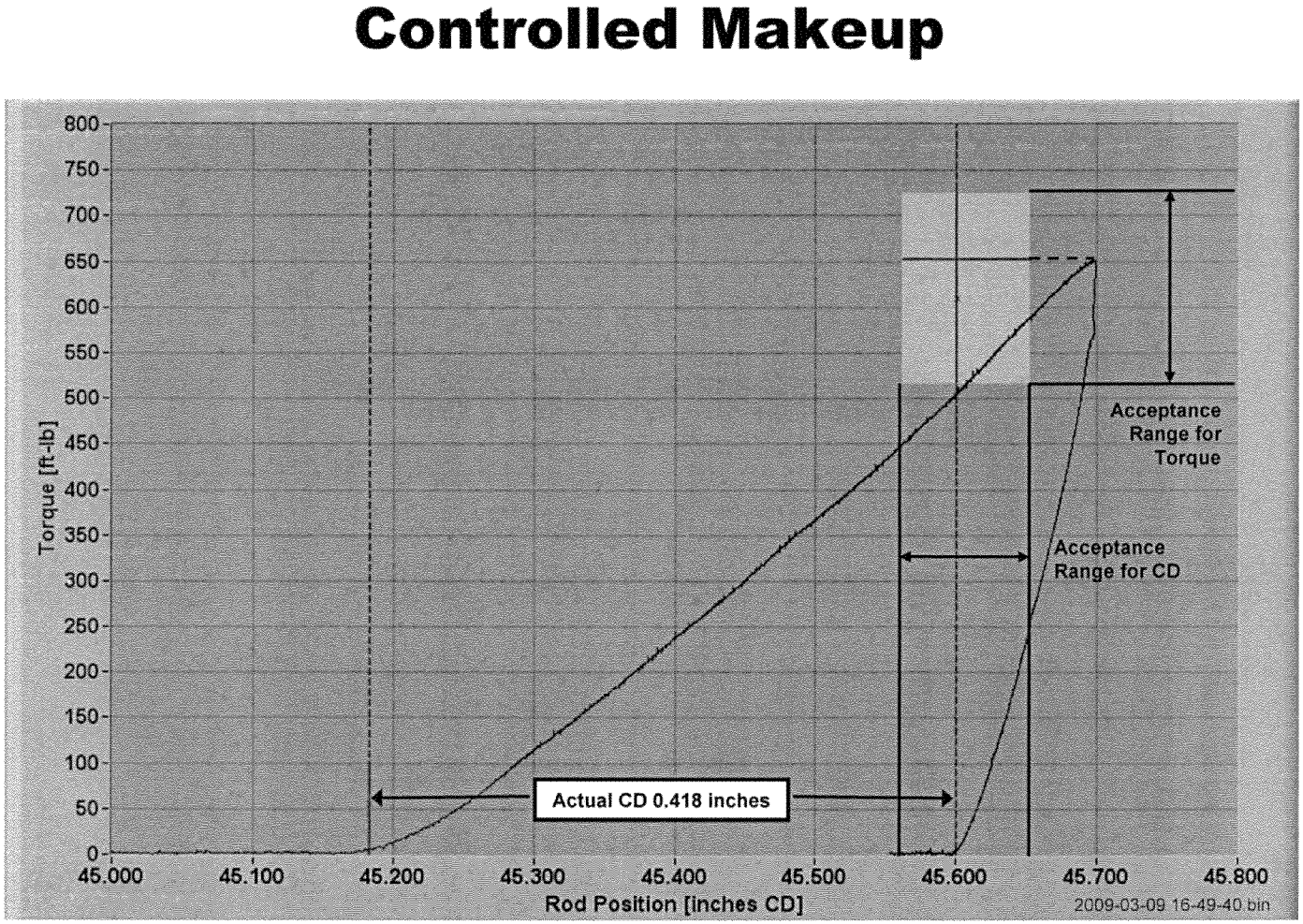
FIG. 9 presents another exemplary chart displaying a comparison of rod speed and torque during the final portion of a make-up process for a rod in accordance with one exemplary embodiment of the present invention.
Figure 10:
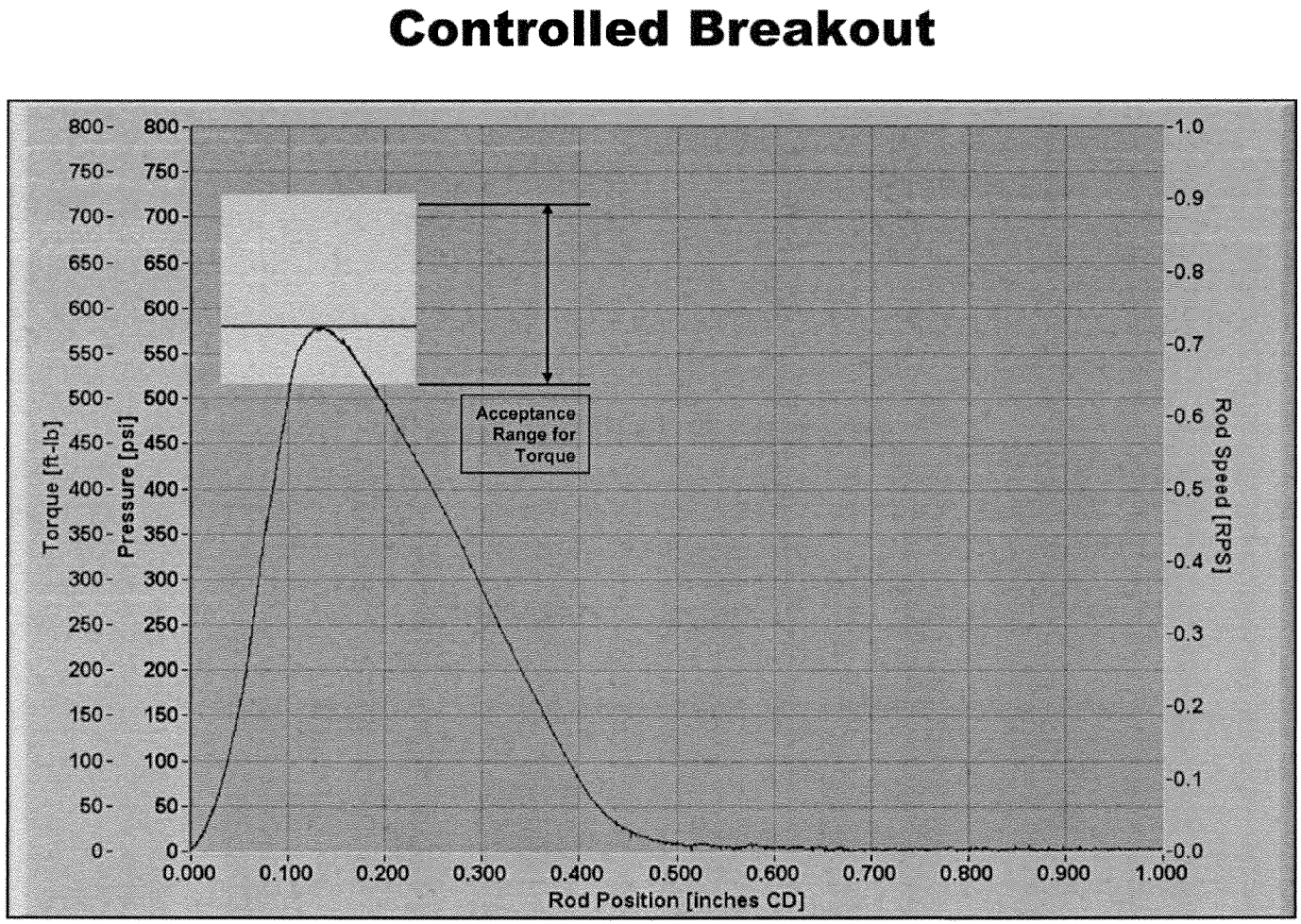
FIG. 10 presents another exemplary chart displaying a comparison of rod speed and torque during a breakout process for a rod in accordance with one exemplary embodiment of the present invention.

The position of the rod 40 in the make-up process is determined in step 345. As stated above, the position is determined based on the data signals received from the encoder 28. In step 350, an inquiry is conducted to determine if the rod 40 has completed a third predetermined number of revolutions in the make-up process. In one exemplary embodiment, the third predetermined number of revolutions is equal to or substantially equal to the sum of the first and second predetermined number of revolutions. Alternatively, the third predetermined number of revolutions is equal to or substantially equal to the second predetermined number of revolutions. The third predetermined number of revolutions is determined by the control processor 20 based on data from the encoder 28, as an estimate of when the shoulder is approaching, at which time the speed of the tongs drive 18 will be slowed and a controlled speed make-up will be used to complete the make-up process, as shown in FIG. 8. In one exemplary embodiment, assuming the rod 40 has ten threads, the rod 40 is generally tightened approximately ten revolutions, of which approximately one revolution is completed manually by the operator, approximately eight revolutions are completed in the high speed spin-up process and about one revolution is completed using the controlled speed process. Thus, in the exemplary embodiment where ten revolutions completes the make-up process, the third predetermined number of revolutions is approximately nine revolutions (approximately one revolution completed by manual thread-up and approximately eight revolutions completed during spin-up). If the predetermined number of revolutions for make-up have not been completed, the NO branch is followed back to step 345 to received additional position data for the rod 40. Otherwise the YES branch is followed to step 355, where the control processor 20 transmits a signal to slow the tongs drive 18 to reduce the make-up speed.

In step 360, the encoder 28 receives speed data based on it sensing one or more components in the drive train 44 and/or the tongs drive 18. The encoder 28 sends the speed data to the control processor 20 in step 365. In step 370, an inquiry is conducted at the control processor 20 or the PC 11 to determine if the actual speed, as determined by the encoder 28, is within a predetermined range of the speed set point that was determined by the PC 11. As stated above, in one exemplary embodiment, the predetermined range is a value either input into or previously stored into the control processor 20. In certain exemplary embodiments, the predetermined range can vary from 0-100 RPMs. For example, if the predetermined range is zero RPMs, then any speed received from the encoder 28 that differs from the speed set point would not be within the predetermined range.

If the actual speed is within a predetermined range of the speed set point, the YES branch is followed to step 375, where the control processor 20 transmits a signal to the PWM amplifier module 35 to maintain signal level to the electric coil solenoid valve 37 to maintain the position of the proportional hydraulic spool valve 39. In one exemplary embodiment, the PWM amplifier module 35 outputs a PWM control signal to the electric coil solenoid valve 37 having 12 volts DC, 20 kHz PWM frequency. The width of the pulses is modulated from 0-100% duty cycle. Further, in this exemplary embodiment, the solenoid coil for the electric coil solenoid valve 37 has a resistance of approximately 7 ohms. So, the current varies from 0-170 mA, corresponding to the 0-100% duty cycle. The process continues from step 375 to step 390.

Returning to step 370, if the actual speed is not within the predetermined range of the speed set point, the NO branch is followed to step 380, where the control processor 20 transmits a signal to the PWM amplifier module 35 to increase or decrease the signal level to the electrical coil solenoid valve 37 based on a determination that the actual speed is too high or too low. The position of the proportional hydraulic spool valve 39 is adjusted accordingly to increase or decrease the flow rate of the hydraulic motor to increase or decrease the speed of the tongs drive 18 in step 385.

Figure 11:
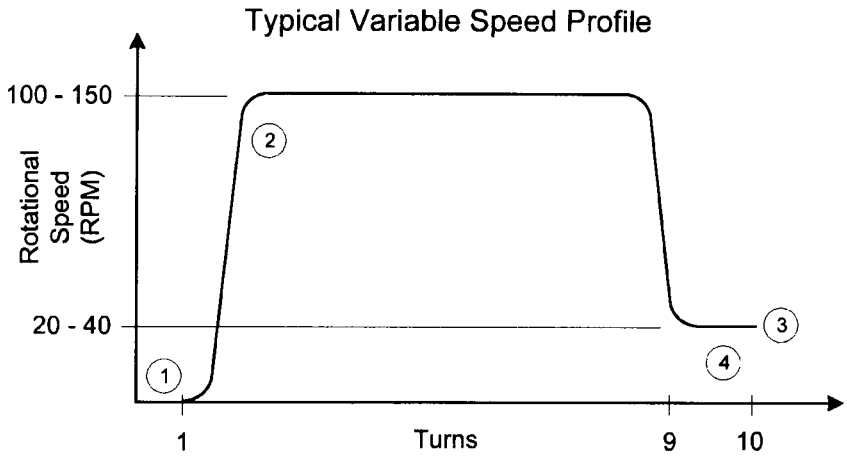
FIG. 11 is a graphical representation showing an example speed profile for the exemplary process described in FIG. 3 in accordance with an exemplary embodiment of the present invention.

In step 390, the control processor 20 determines the position of the rod 40 in the make-up process. In one exemplary embodiment, the position is determined based on data received from the encoder 28 to calculate the number of revolutions in the make-up process that have been completed. In step 392, an inquiry is conducted to determine if the rod make-up is complete. In one exemplary embodiment, this inquiry and analysis can be completed by either the control processor 20, the PC 11 or an operator. If the rod make-up is not complete, the NO branch is followed to step 360 to receive additional speed data from the encoder 28. Otherwise, the YES branch is followed to step 394. FIG. 11 is a graphical representation showing an example speed profile for the exemplary process described in FIG. 3.

In step 394, an inquiry is conducted to determine if additional rods 14 still need to be added to the rod string. In one exemplary embodiment, this determination can be made by either the PC 11, the operator, or another person or device. If another rod 14 needs to be added to the rod string, then the YES branch is followed back to step 325, to retrieve the next sucker rod. On the other hand, if the rod string had been completed, the NO branch is followed to the END step.

Figure 4:
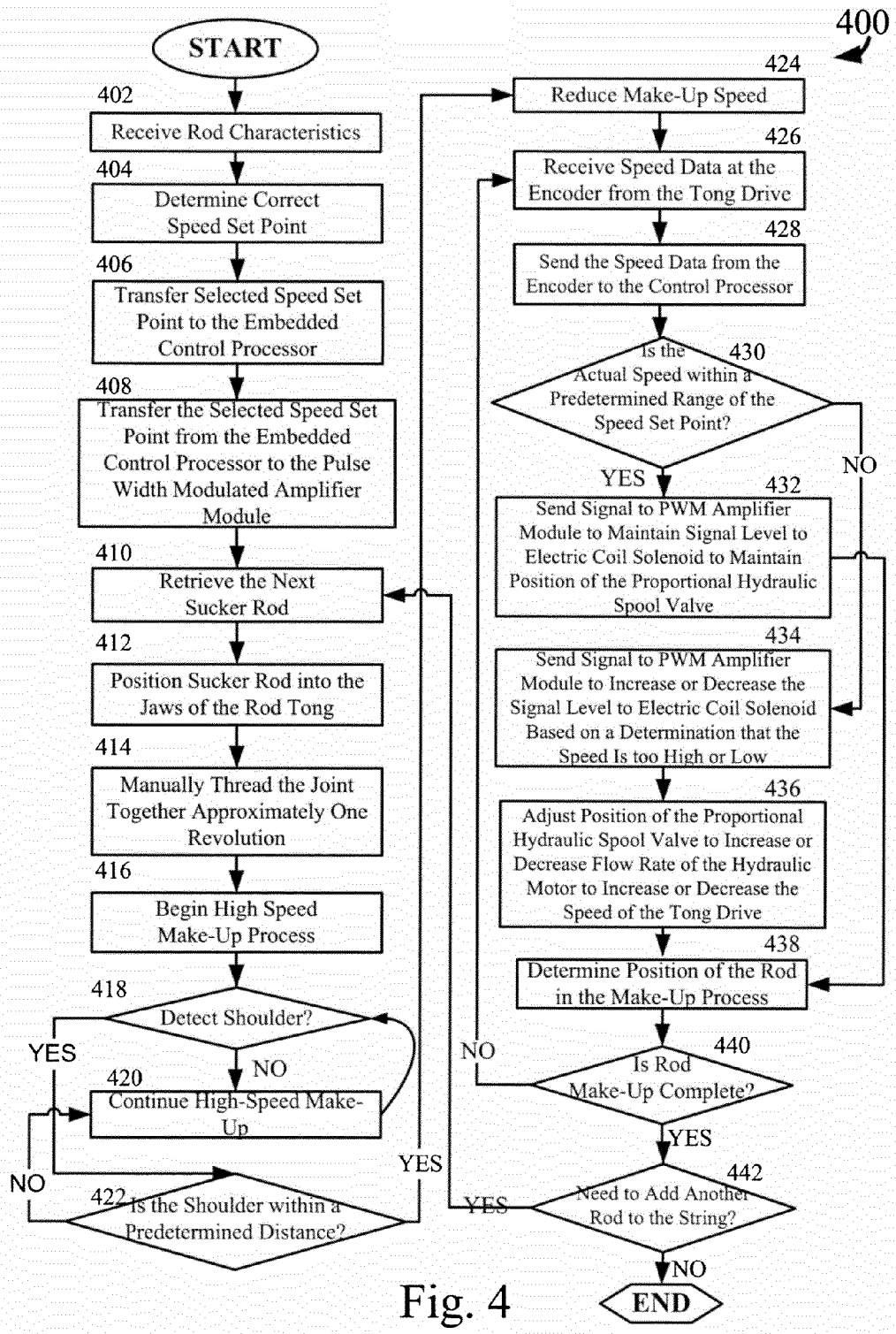
FIG. 4 is a flowchart of an alternative exemplary process for controlling the speed of the tongs drive with varying speeds by sensing the position of the shoulder to determine timing of speed reduction and controlled make-up speeds according to one exemplary embodiment of the present invention.

FIG. 4 is a flowchart of an alternative exemplary process 400 for controlling the speed of the tongs drive 18 with varying speeds by sensing the position of the shoulder to determine timing of speed reduction and controlled make-up speeds within the exemplary operating environment of FIGS. 1, 1A, and 1B. Now referring to FIGS. 1, 1A, 1B, and 4, the exemplary method 400 begins at the START step and proceeds to step 402, where the rod characteristics are input into the input device 13 and received at the PC 11. In one exemplary embodiment, the rod characteristics include, but are not limited to, rod manufacturer, rod grade, rod size, single or double coupling, single, double, or triple rod string, number of threads on each rod end, and whether the rod is new or used. In the exemplary embodiment described below, the number of threads on each rod end is assumed to be ten threads, however, those of ordinary skill in the art will recognize that the number of threads for each rod end varies from 4-17 threads and the predetermined numbers of revolutions described below for each step are adjusted accordingly. In step 404, the PC 11 determines the correct rod make-up speed set point. In one exemplary embodiment, the PC 11 uses a software program and a database of information to determine this set point. In certain exemplary embodiments, the make-up speed set point is within a range of 1-150 RPMs and preferably between 20-40 RPMs. The PC 11 transfers the selected speed set point to the embedded control processor 20 in step 406.

In step 408, the selected speed set point is transferred by the embedded control processor 20 to the PWM amplifier module 35. The next sucker rod 40 is retrieved for coupling in step 410 using known methods and means. In step 412, the sucker rod 40 is positioned into the upper set of jaws 46 on the tongs 12. The rod 40 is manually threaded into a coupling 42 a first predetermined number of revolutions by an operator in step 414. In one exemplary embodiment, the first predetermined number of revolutions of the rod 40 for manual thread-up completed by the operator is approximately one revolution of the rod 40. The high speed make-up process begins in step 416. In the exemplary process 400, after the manual thread-up is completed, the tongs drive 18 begins the high speed spin-up process on the rod 40 (often called "spin-up") until the shoulder position approaches. In one exemplary embodiment, spin-up occurs at a rate of between 40-200 RPMs and preferably at about 150 RPMs. Further, in this exemplary embodiment, the high speed spin-up occurs for approximately a second predetermined number of revolutions, approximately eight revolutions of the rod 40 based on the exemplary rod having ten threads, and based on position feedback data derived from the encoder signals. In alternative exemplary embodiments for rods having greater or fewer than ten threads, the second predetermined number of revolutions is approximately equal to the number of threads for the rod 40 minus the first predetermined number of revolutions and further minus one additional revolution. For example, if the rod 40 has fourteen threads and the manual make-up with the first predetermined number of revolutions was one revolution, then the second predetermined number of revolutions would be approximately twelve revolutions, since fourteen minus one minus one equals twelve.

In step 418, an inquiry is conducted to determine if the shoulder area has been detected. In one exemplary embodiment, sensors (not shown), including optical, magnetic position and/or gap sensors are positioned on the tongs 12 or adjacent to the make-up area to monitor the make-up process and determine when the shoulder is approaching. This sensor could supplant or supplement the data being received from the encoder 28 at the control processor 20 to determine position or revolutions completed by the rod 40, thereby allowing for better accuracy in determining the location of the shoulder and reducing the amount of time and distance that the slowdown and controlled speed make-up occurs. Such a situation decreases the overall amount of time to complete each make-up while still providing for a consistent accurate make-up based on the controlled speed at the end of the make-up process.

If the shoulder has not been detected by the sensor, the NO branch is followed to step 420, where the high speed make-up continues and the process returns to step 418. Otherwise, if the shoulder has been detected by the sensor, the YES branch is followed to step 422. In step 422, an inquiry is conducted at the control processor 14 or the PC 11 to determine if the shoulder is within a predetermined distance. In one exemplary embodiment, the predetermined distance is between 0-1 revolutions of the rod 40 and preferably less than 1 full revolution of the rod 40. If the shoulder is not within the predetermined distance, the NO branch is followed to step 420, where the high speed spin-up process continues. Otherwise the YES branch is followed to step 424.

In step 424, the control processor 20 or the PC 11 transmits a signal to the tongs drive 18 and the tongs drive 18 is slowed to reduce the rod make-up speed. In one exemplary embodiment, the reduced make-up speed is based on the particular rod characteristics and is in a range between 20-50 RPMs and preferably between 30-40 RPMs. In step 426, the encoder 28 receives speed data based on it sensing one or more components in the drive train 44 and/or the tongs drive 18. The encoder 28 sends the speed data to the control processor 20 in step 428. In step 430, an inquiry is conducted at the control processor 20 to determine if the actual speed, as determined by the encoder 28, is within a predetermined range of the speed set point that was determined by the PC 11. In one exemplary embodiment, the predetermined range is a value either input into or previously stored into the control processor 20. In certain exemplary embodiments, the predetermined range can vary from 0-100 RPMs and is preferably between 0-10 RPMs during the high speed spin-up and 0-5 RPMs during the reduced make-up speed. For example, if the predetermined range is zero RPMs, then any speed received from the encoder 28 that differs from the speed set point would not be within the predetermined range.

If the actual speed is within a predetermined range of the speed set point, the YES branch is followed to step 432, where the control processor 20 transmits a signal to the PWM amplifier module 35 to maintain signal level to the electric coil solenoid valve 37 to maintain the position of the proportional hydraulic spool valve 39. In one exemplary embodiment, the PWM amplifier module 35 outputs a PWM control signal to the electric coil solenoid valve 37 having 12 volts DC, 20 kHz PWM frequency. The width of the pulses is modulated from 0-100% duty cycle. Further, in this exemplary embodiment, the solenoid coil for the electric coil solenoid valve 37 has a resistance of approximately 7 ohms. So the current varies from 0-170 mA, corresponding to the 0-100% duty cycle. The process continues from step 432 to step 438.

Returning to step 430, if the actual speed is not within the predetermined range of the speed set point, the NO branch is followed to step 434, where the control processor 20 transmits a signal to the PWM amplifier module 35 to increase or decrease the signal level to the electrical coil solenoid valve 37 based on a determination that the actual speed is too high or too low. The position of the proportional hydraulic spool valve 39 is adjusted accordingly to increase or decrease the flow rate of the hydraulic motor to increase or decrease the speed of the tongs drive 18 in step 436.

In step 438, the control processor 20 determines the position of the rod 40 in the make-up process. In one exemplary embodiment, the position is determined based on data received from the encoder 28 to calculate the number of revolutions in the make-up process that have been completed. In step 440, an inquiry is conducted to determine if the rod make-up is complete. In one exemplary embodiment, this inquiry and analysis can be completed by either the control processor 20, the PC 11 or an operator. If the rod make-up is not complete, the NO branch is followed to step 426 to receive additional speed data from the encoder 28. Otherwise, the YES branch is followed to step 442. The speed profile for the exemplary process described in FIG. 4 is substantially similar to that shown above with respect to FIGS. 3, 8, 9, and 10.

In step 442, an inquiry is conducted to determine if additional rods 14 still need to be added to the rod string. In one exemplary embodiment, this determination can be made by either the PC 11, the operator, or another person or device. If another rod 14 needs to be added to the rod string, then the YES branch is followed back to step 410, to retrieve the next sucker rod. On the other hand, if the rod string had been completed, the NO branch is followed to the END step.

Figure 5:
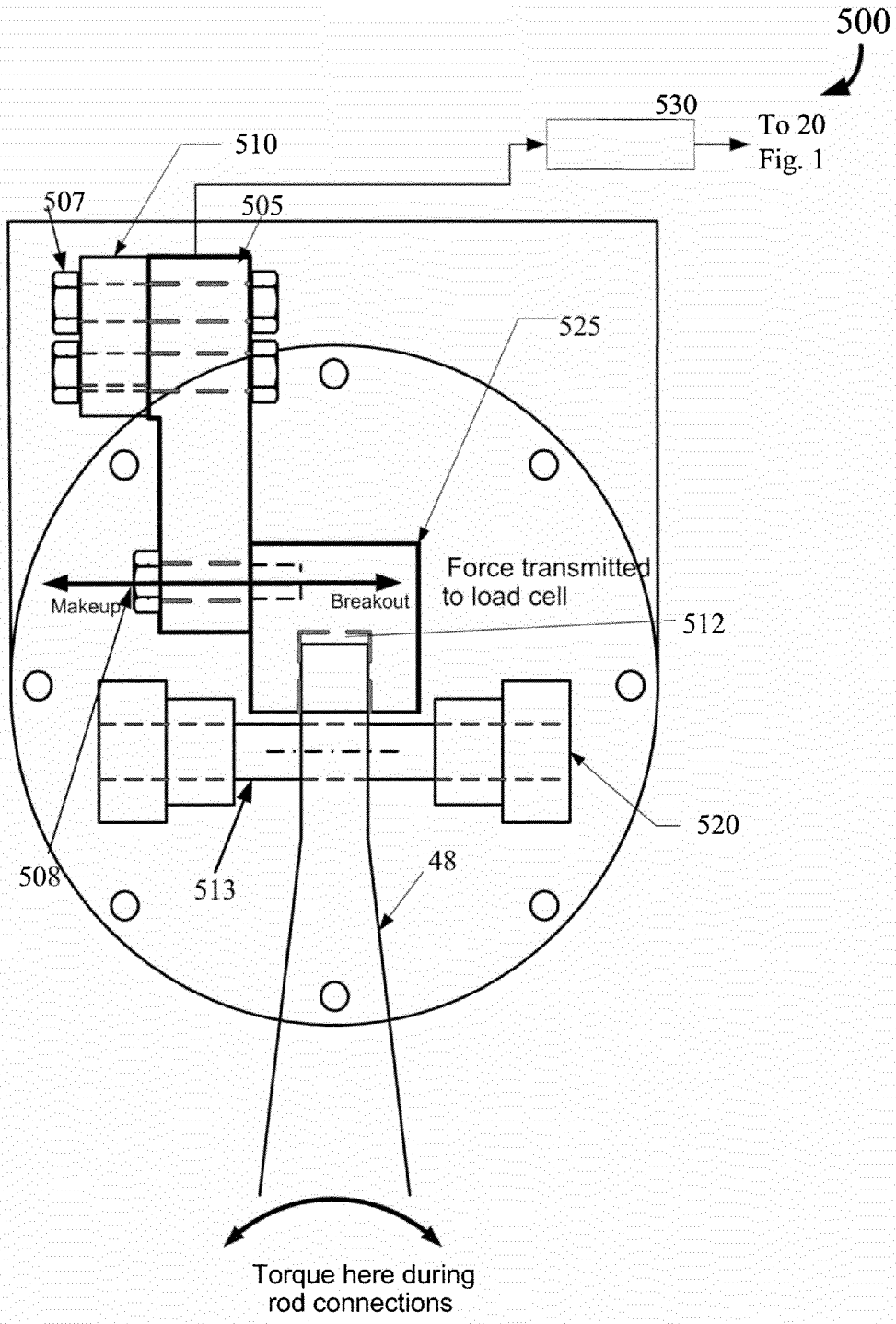
FIG. 5 is an exemplary representation of a cut-away schematic diagram of an alternative tongs system that includes a load cell for measuring torque in accordance with one exemplary embodiment of the present invention.

FIG. 5 is an exemplary representation of a tongs system 500 that includes a load cell for measuring torque incorporated into the tongs 12 of FIG. 1B in accordance with one exemplary embodiment of the present invention. Referring now to FIGS. 1, 1A, 1B and 5, the exemplary system 500 includes a load cell 505 coupled along one end to a mounting block 510 using known coupling means 507 including, but not limited to, bolts and nuts. The load cell 505 is typically positioned adjacent the back-up wrench 48. The load cell 505 is coupled along an opposing end to a receiver block 525 using known coupling means 508 including, but not limited to, bolts and nuts. The receiver block 525 constrains the rear end of the back-up wrench so that force is transmitted into the load cell 505. In one exemplary embodiment, the load cell 505 is a SENSOTEC model 103 2000 kilogram load cell. However, other types of load sensors known to those of ordinary skill in the art could be used and are within the scope and spirit of this invention.

The system 500 further includes a back-up wrench 48 making contact on a first end 512 with the receiver block 525 and receiving a torque along a second end 48 during rod make-up or breakout. The back-up wrench 48 is held in position loosely in the receiver block by a pair of mounting blocks 520 and a retainer pin 513.

In practice, the tongs 12 has a rotating upper jaw 46, driven by the hydraulic motor 18 that turns the flats 50 on the upper rod 40. The flats 52 of the lower rod 38 in the connection are held in the back-up wrench 48. This back-up wrench 48 is held loosely in position using the retainer pin 513, so that it can easily be changed as required to fit differing size rods. When torque is applied to the rod connection, the resulting moment causes the back-up wrench 48 to turn slightly. In a conventional tongs the far end of the back-up wrench comes to rest against a stop which is built into the body of the tongs. This reaction point is what has been adapted to monitor the resulting force with the load cell 505. As the rod 38 receives torque during a make-up or breakout, the back-up wrench 48 is moved at its second end 48, causing an opposing movement in the first end 512 of the back-up wrench 48. Movement of the first end 512 causes a corresponding force in the receiver block 525. Since the load cell 505 is coupled to the receiver block 525 by way of the bolt 508, the corresponding force in the receiver block is sensed by the load cell 505. The control processor 20 is able to calculate the corresponding torque based on the input signal 41 from the load cell sensor 505. In one exemplary embodiment, the calculation is accomplished by previously placing a calibration sensor on the tongs and applying one or more known torques to the calibration sensor. The known torques are compared to the voltage signal outputs for the load cell 505 and scaling is applied to the load cell signal to covert voltage output into foot-pounds of torque.

In one exemplary embodiment, the expected torque generated on make-up is up to 2,000 ft-lb, with breakout torques being even higher, up to 3,000 ft-lb. This generates loads in the load cell 505 up to 3,000 lb. The torque signal from the load cell 505 is sampled by a digital input module 530 electrically coupled to the embedded control processor 20. While a digital input module is described with reference to the exemplary embodiment, those of ordinary skill in the art will recognize that the digital input module could be replaced with an analog input module without departing from the scope and spirit of this invention. In certain exemplary embodiments, the digital input module 530 samples the load cell two ways—first by time, and second triggered by every pulse from the encoder 28. This gives an improved calculation of the connection torque as a function of both time and rod position. In one exemplary embodiment, time-based scanning occurs at a rate of 10,000 samples per second, and the position pulses result in torque data measured between 0 and 100,000 samples per second.

Figure 6:
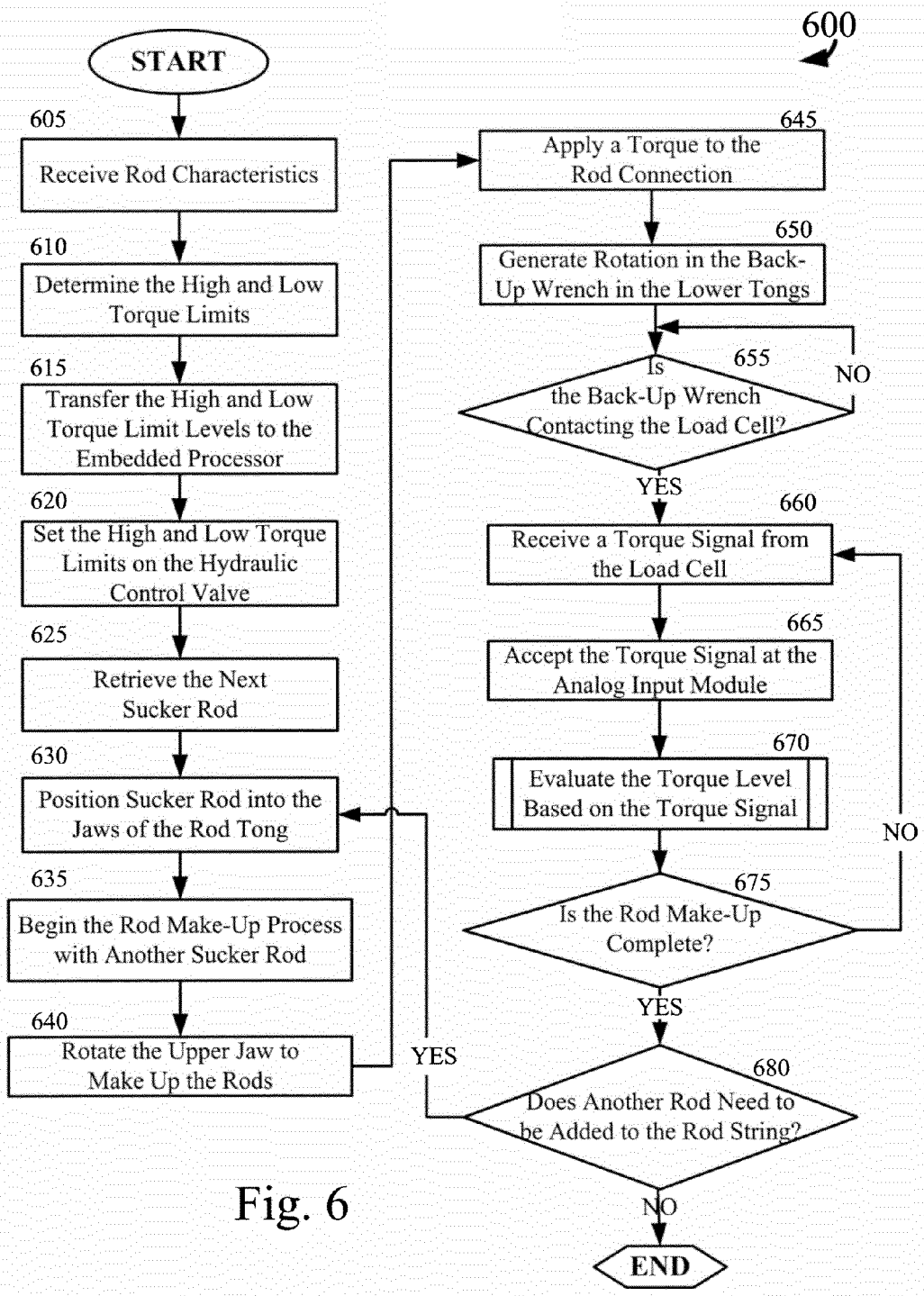
FIG. 6 is a flowchart of an exemplary process for receiving and evaluating a torque from a load cell on a set of tongs in accordance with one exemplary embodiment of the present invention.

FIG. 6 is a flowchart of an exemplary process 600 for receiving and evaluating a torque signal from a load cell 505 on a set of tongs 12 within the exemplary operating environment of FIGS. 1, 1A, 1B, and 5. Now referring to FIGS. 1, 1A, 1B, 5, 6, 9, and 10, the exemplary method 600 begins at the START step and proceeds to step 605, where the rod and/or tongs characteristics are input into the input device 13 and received at the PC 11. In one exemplary embodiment, the rod characteristics include, but are not limited to, rod manufacturer, rod grade, rod size, single or double coupling, single, double, or triple rod string, number of threads on each rod end, and whether the rod 14 is new or used. The high and low torque limits are determined in step 610. In one exemplary embodiment, the high and low torque limits are determined by software in the PC 11 based on the rod and tongs characteristics.

In step 615, the PC 11 transfers the high and low torque limit levels to the embedded control processor 20. The embedded control processor 20 sets the high torque limit on the hydraulic spool valve 39 in step 620. The next sucker rod 40 is retrieved for coupling in step 625 using known methods and means. In step 630, the sucker rod 40 is positioned into the upper set of jaws 46 on the tongs 12. The rod make-up process begins in step 635 by attaching one rod 40 to another rod 38 with the use of a coupling 42. In step 640, the rotating of the upper jaws 46 of the tongs 12 makes-up the rods 38, 40. A torque is applied to the rod connection adjacent the second end 48 of the pin 48 in step 645. A rotation is generated in the back-up wrench 48 of the tongs 12 in step 650.

In step 655, an inquiry is conducted at the control processor 20 or the digital input module 530 to determine if the back-up wrench is contacting and/or applying a torque on the load cell 505 by way of the back-up wrench 48 and the receiver block 525. If no torque is being applied, the NO branch is followed back to step 655 to continue the inquiry. Otherwise, the YES branch is followed to step 660, where a torque signal and/or load signal is generated at the load cell 505. The torque/load signal is transmitted from the load cell 505 to the digital input module 530 and then to the embedded control processor 20 in step 665. In step 670, torque level being applied at the load cell 505 is evaluated based on the torque/load signal being generated. Evaluation of toque is described in more detail in FIG. 7. In one exemplary embodiment, the torque level is evaluated by the control processor 20 and/or the PC 11.

In step 675, an inquiry is conducted to determine if the rod make-up is complete. In one exemplary embodiment, this inquiry and analysis can be completed by either the control processor 20, the PC 11 or an operator. If the rod make-up is not complete, the NO branch is followed to step 660 to receive additional torque/load signal data from the load cell 505. Otherwise, the YES branch is followed to step 680. In step 680, an inquiry is conducted to determine if additional rods 14 still need to be added to the rod string. In one exemplary embodiment, this determination can be made by either the PC 11, the operator, or another person or device. If another rod 14 needs to be added to the rod string, then the YES branch is followed back to step 625, to retrieve the next sucker rod 14. On the other hand, if the rod string had been completed, the NO branch is followed to the END step. While the exemplary process of FIG. 6 is described with reference to a rod make-up process, the process of analyzing and evaluating torque described in FIG. 6 is also used in a rod break-out process, including, but not limited to a process that includes steps of FIG. 6 other than steps 625-635 and for which step 675 would be modified to determine if the breakout is complete and step 680 would be modified to determine if another rod needs to be removed from the rod string.

Figure 7:
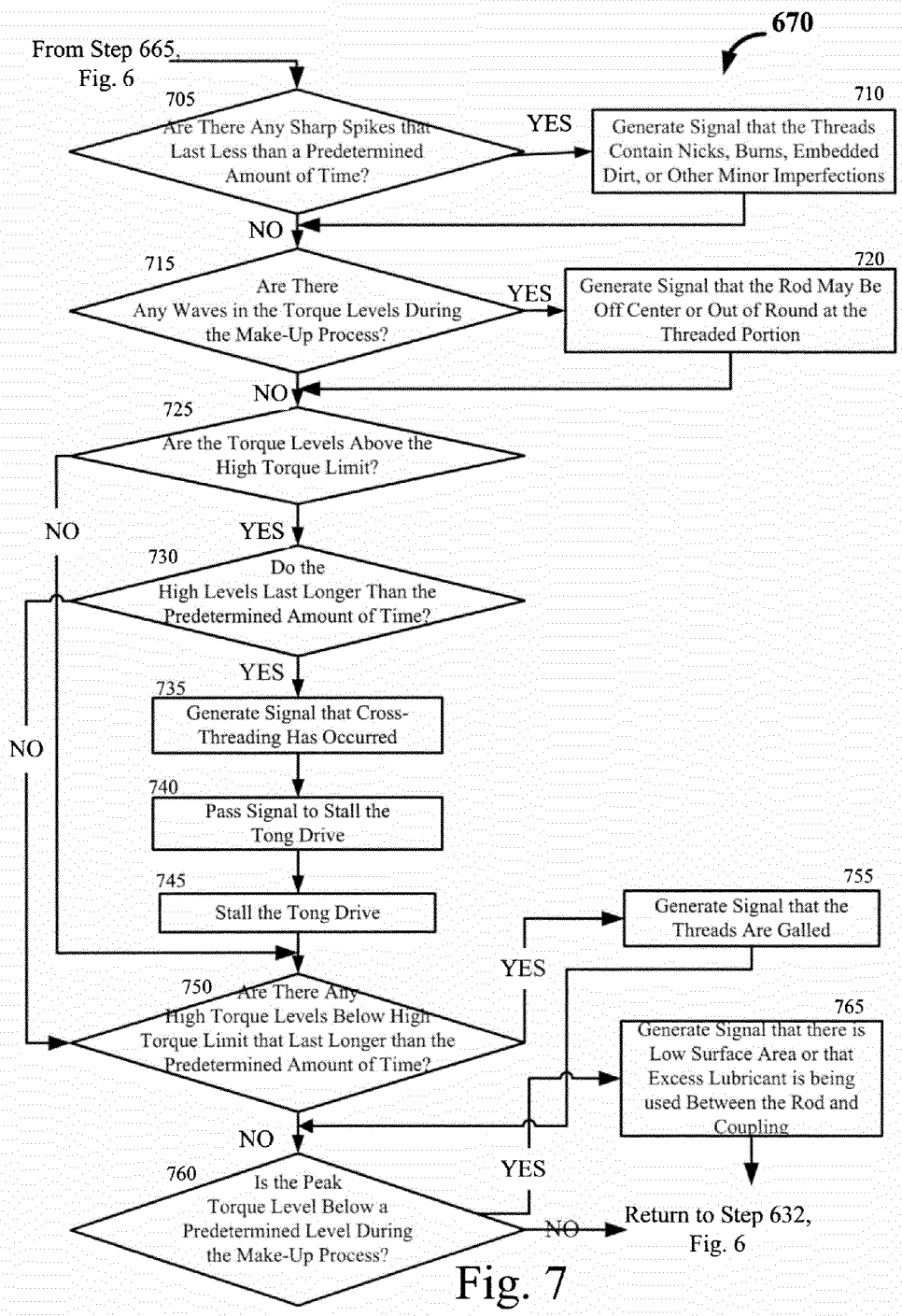
FIG. 7 is a flowchart of an exemplary process for evaluating the torque level based on the torque signal within the exemplary process of FIG. 6.

FIG. 7 is a flowchart of an exemplary process for evaluating the torque level based on the torque signal within the exemplary process of FIG. 6. Referring now to FIGS. 1, 1A, 1B, and 5-7, the exemplary method 670 begins with an inquiry at the control processor 20 or PC 11 in step 705 to determine if there are any sharp spikes in the torque/load data. Sharp spikes indicate localized defects, such as nicks, burrs, or embedded dirt on the threads of the rods 38, 40 or couplings 42. In one exemplary embodiment, spikes can be determined based on an increased torque/load level that lasts less than a predetermined amount of time. In this exemplary embodiment, the predetermined amount of time is typically much less than one second. If there are sharp spikes in the torque/load data, the YES branch is followed to step 710, where a signal is generated that the threads contain nicks, burrs, embedded dirt, and/or other minor imperfections. In one exemplary embodiment, the signal is generated by the embedded processor 20 or the PC 11. In this exemplary embodiment, the signal can be an audio or visual signal and, if visual, is displayed on alarm panel lights 86,88 and/or one or both of the monitor 23 and at the tongs 12. In the exemplary embodiment wherein the signal is an audio signal, the audio signal is typically output at the speaker 90 or one of the PC 11 the tongs 12 or other places around the work area. The process then continues to step 715. If there are no sharp spikes, the NO branch is followed to step 715.

In step 715, an inquiry is conducted by the control processor 20 or PC 11 to determine if there are any waves in the torque/load data levels during the make-up process. Out-of-round or off center machining of the rods 38, 40 or coupling 42, typically show up as waves in the torque/load data readings. If waves are identified in the torque/load data, the YES branch is followed to step 720, where a signal is generated that the rod 38, 40 or coupling 42 may be off center or out of round along the threaded portion. In one exemplary embodiment, the signal is generated by the embedded processor 20 or the PC 11. In this exemplary embodiment, the signal can be an audio or visual signal and, if visual, is displayed on alarm panel lights 86,88 and/or one or both of the monitor 23 and at the tongs 12. In the exemplary embodiment wherein the signal is an audio signal, the audio signal is typically output at the speaker 90 or one of the PC 11 the tongs 12 or other places around the work area. The process then continues to step 725. If no waves are identified, the NO branch is followed to step 725.

In step 725, an inquiry is conducted by the control processor 20 or PC 11 to determine if there are any torque levels above the high torque limit. If not, the NO branch is followed to step 750. Otherwise, the YES branch is followed to step 730. In step 730, an inquiry is conducted by the control processor 20 or PC 11 to determine if the torque levels above the high torque limit last longer than a predetermined amount of time. The predetermined amount of time is selectable at the PC 11 by way of the input device 13 and can range from 0-5 seconds. Alternatively, the predetermined amount of time may be fixed within the system prior to deployment in the field and is not adjustable. In certain embodiments, it may be advantageous for the predetermined amount of time to be greater than a fraction more than zero seconds to prevent the system from shutting down based on a single or limited amount of nearly instantaneous and potentially erroneous torque/load signals that are above the high torque limit. If the high torque/load level does not last longer than the predetermined amount of time, the NO branch is followed to step 750. Otherwise, the YES branch is followed to step 735, where a signal is generated by the control processor 20 or the PC 11 that alerts the operator to a potential cross-threading of the rods and/or coupling. A signal is transmitted by the control processor 20 or the PC 11 to stall the tongs drive 18 in step 740. In step 745, the tongs drive 18 is stalled to protect it from further damage. In addition, in certain exemplary embodiments, an audible alarm is generated at the speaker 90 and/or a visual alarm is generated at the alarm panel lights 86,88 or the monitor 23. In one exemplary embodiment, the signals are generated by the embedded processor 20 or the PC 11. The process continues to step 750.

In step 750, an inquiry is conducted by the control processor 20 or the PC 11 to determine if there are any high torque levels that are below the high torque limit and that last longer than the predetermined amount of time referenced in regards to step 705. If so, the YES branch is followed to step 755, where a signal is generated that the threads may be galled. Larger, or longer imperfections such as galled threads typically result in longer signatures in the torque/load readings. The signal may generate an audible or visual alarm that occurs at the speaker 90, panel lights 86, 88, and/or the monitor 23. The process continues to step 760. If there are no high torque levels below the high torque limit but lasting longer than the predetermined amount of time, the NO branch is followed to step 760. In step 760, an inquiry is conducted by the control processor 20 or PC 11 to determine if the peak torque level is below a second predetermined level for the make-up process. Excess lubricant between the rod and coupling threads or low surface area typically result in a consistently low torque/load level. If the peak torque level is below the second predetermined level, the YES branch is followed to step 765, where a signal is generated that there is a low surface area or that excess lubricant is being used between the rod and coupling threads. In one exemplary embodiment, the signal is generated by the embedded processor 20 or the PC 11. The signal may generate an audible or visual alarm that may occur at the speaker 90, panel lights 86, 88, and/or the monitor 23. The process continues to step 632 of FIG. 6. Returning to step 760, if peak torque level is above the second predetermined level for the make-up process, then the NO branch is followed to step 675 of FIG. 6. While the exemplary process of FIG. 7 is described with reference to a rod make-up process, the process of analyzing and evaluating torque described in FIG. 7 is also used in a rod break-out process, including, but not limited to a process that includes the steps of FIG. 7, in which make-up is replaced with breakout.

Although the invention is described with reference to a preferred embodiment, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

We claim:

1. A system for monitoring the torque at a set of rod tongs during a make-up process, comprising;

rod tongs comprising an upper jaw and a back-up wrench;

a load cell positioned adjacent the back-up wrench; and a block member capable of being in contact with the load cell, wherein the block member transmits a force from the back-up wrench to the load cell, the force generating the load signal at the load cell, wherein in response to a torque being applied to a rod held by the rod tongs, the second end of the back-up wrench moves in a first direction;

wherein the movement of the second end of the back-up wrench in the first direction causes a corresponding move of the first end of the back-up wrench in a second direction opposite the first;

wherein movement of the first end of the back-up wrench in the second direction generates a corresponding force in the block member in the second direction; and wherein the load cell senses the force from the block member in the second direction and generates a torque signal.

2. The system of claim 1, wherein the load cell generates a load signal based on the torque generated in a rod during the make-up process.

3. The system of claim 1, wherein the load cell comprises a first end and an opposing second end, wherein the first end is coupled to a mounting block on the tong and the second end is coupled to the block member.

4. The system of claim 1, further comprising:

a digital input module communicably coupled to the load cell; and a processor communicably coupled to the digital input module;

wherein processor calculates a torque based on the torque signal.

5. The system of claim 4, further comprising an encoder communicably coupled to a digital input module, wherein the encoder generates a plurality of pulses and wherein the analog input module accepts a torque signal from the load cell which is sampled upon receipt of each pulse from the encoder.

6. A method of evaluating a torque signal from a set of tongs comprising a tong drive, the tong drive comprising a set of upper jaws and a back-up wrench, the method comprising the steps of:

accepting at a processor a high torque limit for a rod make-up process;

accepting at the processor a predetermined amount of time;

conducting the make-up process of a rod and a coupling with the tongs by applying with the upper jaws a torque on the rod;

applying with the upper jaws a torque on the rod;

receiving a torque signal from a load cell representing an actual torque;

determining with a processor if the actual torque is greater than the high torque limit;

determining with the processor if the actual torque is greater than the high torque limit for a time period equal to or longer than the predetermined amount of time based on a positive determination that the actual torque is greater than the high torque limit; and automatically stalling the tong drive in response to a positive determination by the processor that the actual torque is greater than the high torque for a time period equal to or longer than the predetermined amount of time.

7. The method of claim 6, further comprising the step of, in response to a determination that the time period is less than the predetermined amount of time, generating a signal that at least one set of threads in the rod or the coupling comprises minor imperfections.

8. The method of claim 7, wherein the minor imperfections are selected from a group consisting of: nicks, burrs and embedded dirt.

9. The method of claim 6, further comprising the steps of:

receiving a plurality of actual torque data during the make-up process;

generating a graphical depiction of the plurality of actual torque data;

evaluating with the processor the plurality of actual torque data to determine if the graphical depiction of at least a portion of the actual torque data comprises at least one wave; and generating a signal with the processor of an imperfection in the rod.

10. The method of claim 9, wherein the imperfection is selected from the group consisting of: the rod being off center and a threaded portion of the rod is misshaped.

11. The method of claim 6, further comprising the steps of:

accepting at a processor a low torque limit for the rod make-up process;

accepting a plurality of actual torque data from the load cell during the make-up process;

determining with the processor if the actual torque is less than the low torque limit for a majority of the make-up process for the rod; and generating a signal with the processor representing a problem with the rod make-up process.

12. The method of claim 11, further comprising the steps of:

receiving at an input device at least one rod characteristic associated with the rod used in the make-up process;

transmitting the rod characteristic to the processor;

determining the high torque limit for the rod make-up process based at least in part on the rod characteristic; and determining the low torque limit for the rod make-up process based at least in part on the rod characteristic.

13. The method of claim 6, further comprising the steps of:

receiving at an input device at least one rod characteristic associated with the rod used in the make-up process;

transmitting the rod characteristic to the processor; and determining the high torque limit for the rod make-up based at least in part on the rod characteristic.

14. The method of claim 6, further comprising the steps of:

generating a rotation in the back-up wrench; and contacting the load cell with the back-up wrench in response to the rotation generated in the back-up wrench;

wherein the contact between the back-up wrench and the load cell generates the torque signal in the load cell.

* * * * *